US007922857B2

(12) United States Patent
Okuno et al.

(10) Patent No.: US 7,922,857 B2
(45) Date of Patent: Apr. 12, 2011

(54) LABEL JOINING METHOD AND LABEL JOINING APPARATUS

(75) Inventors: Chouhei Okuno, Ibaraki (JP); Masayuki Yamamoto, Ibaraki (JP)

(73) Assignee: Nitto Denko Corporation, Osaka (JP)

( * ) Notice: Subject to any disclaimer, the term of this patent is extended or adjusted under 35 U.S.C. 154(b) by 304 days.

(21) Appl. No.: 12/252,249

(22) Filed: Oct. 15, 2008

(65) Prior Publication Data

US 2009/0133815 A1 May 28, 2009

(30) Foreign Application Priority Data

Nov. 26, 2007 (JP) ..... 2007-304523

(51) Int. Cl.
*B65C 9/26* (2006.01)

(52) U.S. Cl. ..... 156/247; 156/344

(58) Field of Classification Search ..... 156/247, 156/344, 238, 540, 541, 542, DIG. 38
See application file for complete search history.

(56) References Cited

U.S. PATENT DOCUMENTS

| | | | | |
|---|---|---|---|---|
| 3,428,509 | A * | 2/1969 | Messmer | 156/361 |
| 5,300,160 | A * | 4/1994 | Wilson et al. | 156/64 |
| 6,672,356 | B1 * | 1/2004 | Jenkins et al. | 156/540 |
| 6,758,254 | B2 * | 7/2004 | Moore et al. | 156/540 |
| 6,913,662 | B2 * | 7/2005 | Barilovits et al. | 156/60 |
| 2006/0027332 | A1 * | 2/2006 | Dangami | 156/541 |

FOREIGN PATENT DOCUMENTS

| | | | |
|---|---|---|---|
| EP | 476447 | A1 * | 3/1992 |
| JP | 10-264915 | A | 10/1998 |

* cited by examiner

*Primary Examiner* — Khanh Nguyen
*Assistant Examiner* — John Blades
(74) *Attorney, Agent, or Firm* — Cheng Law Group, PLLC

(57) ABSTRACT

A receiver base receives from below a front end portion of a label that is fed forward from a folded-back portion of an release paper and droops forward, so that the label is held in a predetermined forwardly and downwardly inclined posture. In a process of separating and feeding the label in such a state where part of a rear end of the label is joined and held onto the release paper, a suction head having a downward suction surface that is inclined forward and downward is brought closer to a top surface of the label being separated so as to suck the label.

4 Claims, 5 Drawing Sheets

LABEL JOINING METHOD AND LABEL JOINING APPARATUS

BACKGROUND OF THE INVENTION (1) Field of the Invention

The present invention relates to a label joining method and a label joining apparatus for separating from an release paper a label having a surface on which a two-dimensional barcode, a QR code (registered trademark), a character, a symbol, or the like is printed, and joining the label to a work piece.

(2) Description of the Related Art

To separate a label from an release paper when joining the label, there is known a method in which the release paper holding the label joined onto a top surface is folded back and reversed at a front end of an edge member while the release paper is being fed forward, and the label to be separated from the release paper by such folding-back is suction-held by a suction head from a printed surface of the label, while air is being blown to an adhesive surface of the label (see Japanese Laid-Open Patent Publication No. 10-264915).

In the above-mentioned method, the suction head is disposed in a standby state in front of the edge member such that a suction surface is laid horizontal. The label is fed forward from a folded-back position of the release paper while blowing air from below to the label fed forward from the folded-back position of the release paper at the front end of the edge member. At this time, the label trying to droop downward due to its own weight is lifted up by the air. The suction head sucks the label through a suction surface directed downward with part of a rear end of the label being held onto the release paper. Due to such a phenomenon, the label fed forward from the folded-back position of the release paper is fed forward while being vibrated or waved by the air blown from below.

In this case, when the label is moved forward, a top surface of the vibrated or waved label repeatedly hits the suction surface of the suction head on standby. Consequently, the top surface of the label is rubbed with the suction surface of the suction head. There sometimes occurs a problem that barcode information printed on the top surface of the label may be damaged by such rubbing.

Further, the adhesive surface on a bottom surface of the label is exposed to blowing air for a long period of time because air blow treatment is carried out through the entire processes of suction-holding the label. As a result, there occurs another problem that adhesion of the adhesive surface may be deteriorated.

SUMMARY OF THE INVENTION

An object of the present invention is to provide a label joining method and a label joining apparatus in which a label separated from an release paper can be suction-held by a suction head and joined to a work piece without damaging a printed matter on a surface of the label.

To achieve the above-described object, the present invention adopts the following configuration.

A label joining method for folding back and reversing an release paper holding a label joined thereon while the release paper being fed forward, suction-holding from above by a suction head a printed surface of the label separated from the release paper by the folding-back and fed forward, and feeding and joining the label to a work piece, the method including the step of:

release paper release paper.suction-holding the downward suction surface of the suction head onto the label by approaching the suction head in a forwardly inclined posture to a top of the label being separated so as to make the label and the suction surface parallel to each other under a state where a part of a rear end portion of the label is kept joining and holding onto the release paper while a front end portion of the label fed forward from a folded-back position of the release paper is received to on a lifting receiver base keep the label in a forwardly and downwardly inclined posture and by pressing the label to the work piece.

According to the label joining method of the present invention, when the release paper is folded back and reversed to be transferred, thereby the label joined and held onto the release paper is separated from the release paper at the folded-back and reversed position and fed forward. At this time, the label droops to be inclined forward and downward due to its own weight. The front end portion of the label that is fed from the folded-back and reversed position and droops to be inclined is received and supported from below by the receiver base. At this time, the receiver base is lifted so that the forwardly and downwardly inclined posture of the label is kept constant.

In a process of progressing the feeding-forward, with part of the rear end portion of the label joined and held onto the release paper, the suction head of which the downward suction surface is inclined forward and downward is brought closer to the top surface of the label being separated. Consequently, the suction head is brought closer to the label received and supported in a predetermined inclined posture forward and downward, in substantially parallel with each other, and the label is then suction-held by the suction surface of the suction head.

In a process of feeding the label until being sucked, the label is in a free state such that the front end portion thereof is supported by the receiver base. That is, feeding of the label is progressed without the label being in contact with or in sliding contact with the suction head. In a state just before the rear end portion of the label is separated from the release paper while feeding of the label is progressed, the label is suction-held by the suction head in the forwardly and downwardly inclined posture. Therefore, there never occurs that the top surface of the label is in sliding contact with the suction head such that a printed matter on the top surface of the label is damaged.

In the meantime, the receiver base is preferably lifted in synchronism with the forward moving speed of the release paper.

Moreover, in this method, when the label is sucked by the suction head, air may be blown to the label from below.

According to this method, no air is blown to the adhesive surface before the label is sufficiently fed, and air is blown from below only in a suction process. Therefore, the downward adhesive surface of the label is not exposed to the air blow for an undesirably long period. Consequently, secure suction can be realized by pressing up the label with a minimal amount of air blow.

In this method, after the label is sucked by the suction head in the process of separating the label from the release paper, the suction head is preferably moved forward in a forwardly and downwardly inclined direction at a speed synchronous with the forward moving speed of the release paper.

According to this method, the suction head is moved forward in the forwardly and downwardly inclined direction at the speed synchronous with the forward moving speed of the release paper under a state where most of the label fed forward being suction-held by the suction head. Therefore, as the rear end portion of the label is fed forward from the folded-back position of the release paper, the label is brought closer to the suction surface of the suction head moving downward and forward and is sucked smoothly without any difference in relative speed. Therefore, the printed surface is kept from being rubbed by the suction head.

To achieve the above described object, the present invention adopts the following configuration.

A label joining apparatus for folding back and reversing an release paper holding a label joined thereto while the release paper being fed forward, suction-holding from above by a suction head a printed surface of the label that is separated from the release paper by the folding-back and is fed forward, and feeding and joining the label to a work piece, the apparatus including:

an edge member for folding back and reversing the release paper that is transferred with the label joined and held thereonto;

a liftable receiver base for receiving a forwardly and downwardly drooping front end of the label that is separated from the release paper folded back and reversed by the edge member and fed forward;

a suction head having a downward suction surface to be parallel to an forwardly and downwardly inclined posture of the label separated from the release paper and fed forward; and a moving mechanism for moving the suction head between a label joining position to the work piece and a label suction position.

This configuration enables the label joining method of the present invention to be preferably realized.

In the meantime, preferably, this configuration further includes the followings:

a controller for controlling operation of the moving mechanism so that the suction head is moved forward in a forwardly and downwardly inclined direction at a speed synchronous with a forward moving speed of the release paper after the label is sucked by the suction head in a process of separating the label from the release paper; or a moving mechanism for lifting the receiver base; and a controller for controlling operation of the moving mechanism so that the receiver base is lowered at a speed synchronous with the forward moving speed of the release paper simultaneously when the receiver base receives the front end of the label.

Such a configuration can prevent the printed surface from being rubbed by the suction head.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Hereinafter, an embodiment of the present invention will be described with reference to the accompanying drawings.

Figure 1:
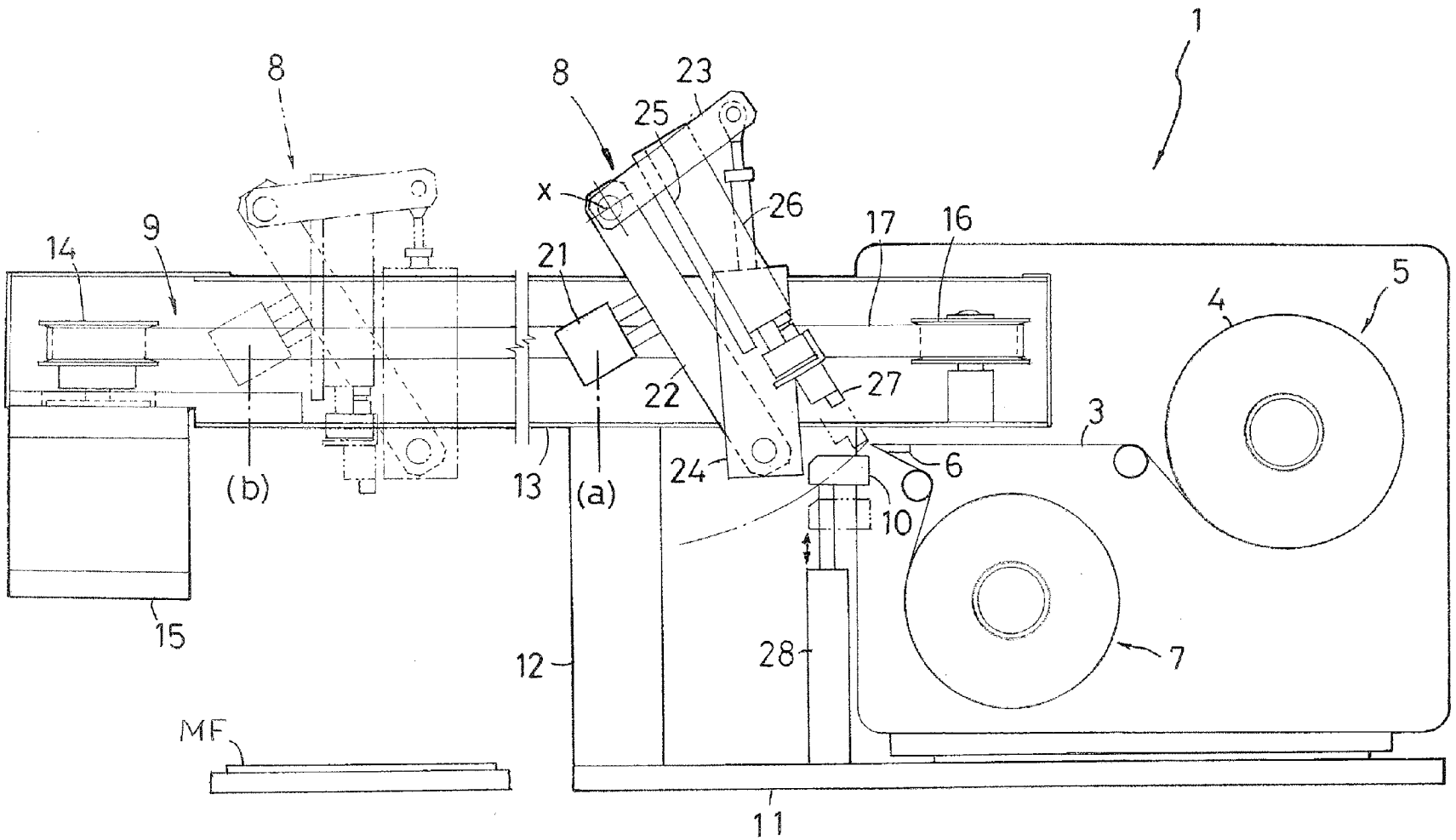
FIG. 1 is a side view of a label joining apparatus.
Figure 3:
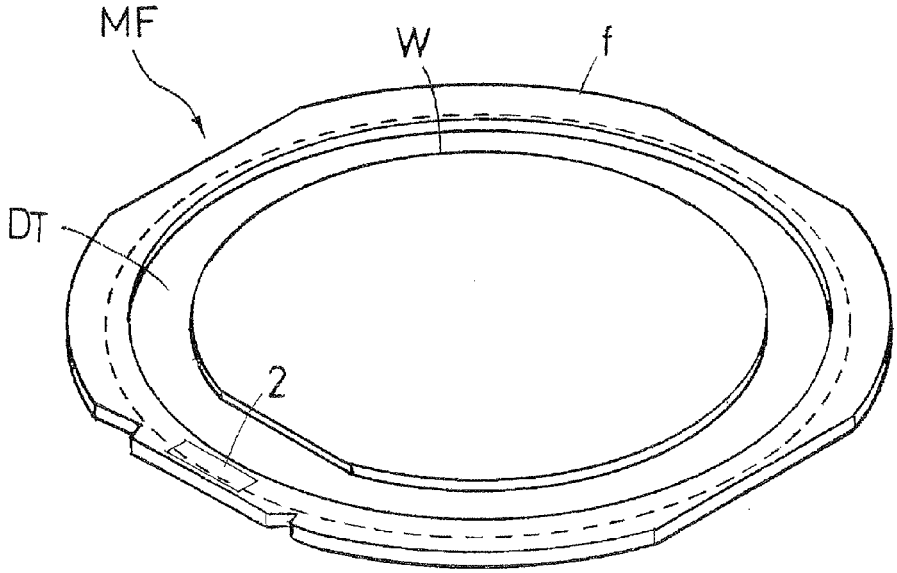
FIG. 3 is a perspective view showing a work piece to which a label is joined.

FIG. 1 is a side view of a label joining apparatus 1 according to the present invention. FIG. 3 is a perspective view of a mount frame MF which is an example of a work piece to which a separated label 2 is joined.

As shown in FIG. 3, the mount frame MF is produced by joining and holding a semiconductor wafer W (hereinafter, simply referred to as "wafer W") onto a ring frame f via a dicing tape DT. In this mount frame MF, the label 2 having a surface printed thereon with various kinds of information for individual recognitions, etc. in the form of a two-dimensional barcode or a QR code is joined to an appropriate position of the ring frame f. The mount frame MF is transferred to a subsequent dicing process or a chip mounting process after dicing in this state.

Figure 2:
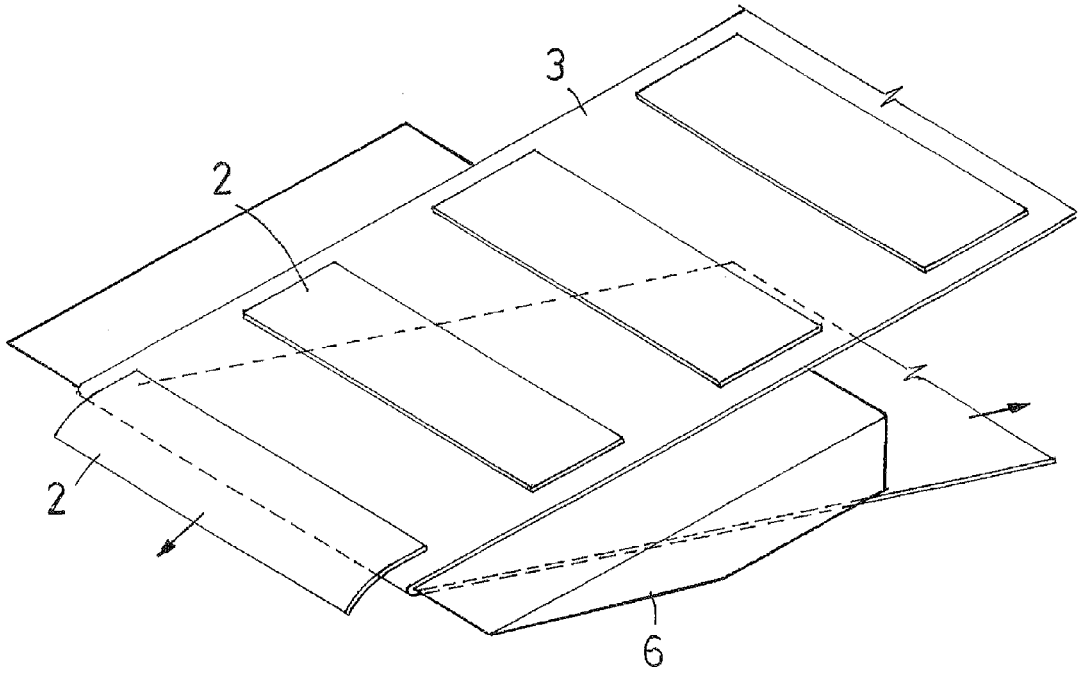
FIG. 2 is a perspective view of a folded-back and reversed portion of an release paper.

In the present embodiment, the label 2 is produced by printing a two-dimensional barcode on the surface (front surface) of a label main body that is cut into a laterally extending rectangular shape, and has an adhesive surface on a rear surface (bottom surface). As shown in FIG. 2, the labels 2 are joined and held onto a continuous tape-shaped release paper 3 so as to be arranged in a line at a predetermined pitch when they are supplied.

The label joining apparatus 1 includes a label supply part 5 that horizontally supports an master roll 4 of the release paper 3 holding the labels 2 joined thereto, a sharp edge member 6 that guides forward the release paper 3 fed from the master roll 4 in a substantially horizontal posture and folds back to reverse the release paper 3, an release paper collecting part 7 that winds up to collect the folded back and reversed release paper 3, a pickup mechanism 8 that suction-holds the label 2 separated from the release paper 3, a transfer mechanism 9 that reciprocates the pickup mechanism 8 back and forth, and a receiver base 10 that is disposed perpendicularly below in front of the edge member 6.

The transfer mechanism 9 is constituted of a transfer frame 13 that is coupled to and supported by a vertical frame 12 arranged upright from a base 11, a drive pulley 14 of a vertical shaft type that is disposed at a front end portion of the transfer frame 13, a motor 15 that drives the drive pulley 14, an idle pulley 16 that is disposed at the rear portion of the transfer frame 13, and a transfer belt 17 of a non-slip type that is wound around the drive pulley 14 and the idle pulley 16. The transfer belt 17 is moved longitudinally by controlling forward and reverse rotations of the motor 15, so as to reciprocate the pickup mechanism 8 coupled to and supported by the transfer belt 17 between a pick-up position a in front of the edge member and a joining position b apart forward.

The pickup mechanism 8 includes a movable base 21 that is coupled and fixed to the transfer belt 17, a vertically elongated supporting frame 22 that is supported and fixed obliquely to this movable base 21, an operating arm 23 that is pivoted and coupled to a top end portion of the supporting frame 22 so as to be swingable around a supporting point x, a swing cylinder 24 that is installed between the operating arm 23 and a bottom end portion of the supporting frame 22, a lifting cylinder 26 that is coupled to an intermediate portion of the operating arm 23 via a bracket 25 and is extended downward, and a suction head 27 that is provided on a bottom end portion of the lifting cylinder 26. In the meantime, the pickup mechanism 8 corresponds to the moving mechanism of the present invention.

The position of the suction head 27 can be changed by expanding and contracting the swing cylinder 24 to swing the suction head 27 around the supporting point x and by expanding and contracting the lifting cylinder 26. For example, at the pick-up position a, the suction head 27 can be moved toward or away from the edge member 6.

The receiver base 10 is provided at the top end of the lifting cylinder 26 arranged upright from the base 11 and is capable of lifting.

A series of label joining operations using the label joining apparatus 1 configured as mentioned above will be described with reference to FIGS. 4 to 7.

Figure 4:
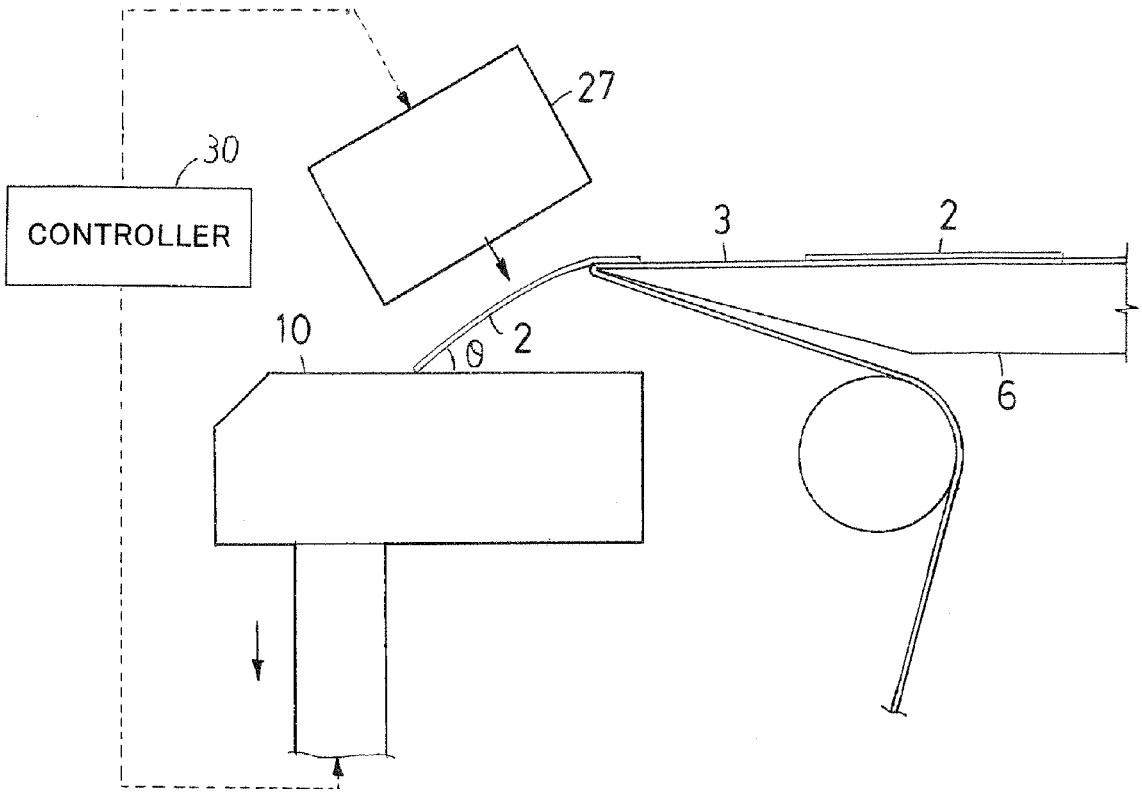
FIG. 4 is a side view of major portions showing a label joining process.

As shown in FIGS. 2 and 4, the release paper 3 holding the label 2 joined thereto is folded back and reversed at the front end portion of the edge member 6 and is transferred to the release paper collecting part 7 at a predetermined speed. At this time, the label 2 joined and held onto the top surface of the release paper 3 is separated by the edge member 6 at the folded-back portion and is fed forward, and the label 2 droops forward and downward to be inclined due to its own weight.

The receiver base 10 stands by at a predetermined height so as to receive and support the label 2 at a predetermined inclination angle θ (inclined posture), in correspondence with the size (a width and a length), thickness (bending resistance), and the like of the label 2. As shown in FIG. 4, after the receiver base 10 receives and supports the label 2 in a predetermined inclined posture, the controller 30 lowers the receiver base 10 synchronously with the feeding speed of the label 2, while maintaining the predetermined inclined posture of the label 2. In this case, the pickup mechanism 8 is located at the pick-up position a in front of the edge member, the operating arm 23 is swung toward the edge member, and the suction head 27 is located at a standby position above the base 10.

Figure 5:
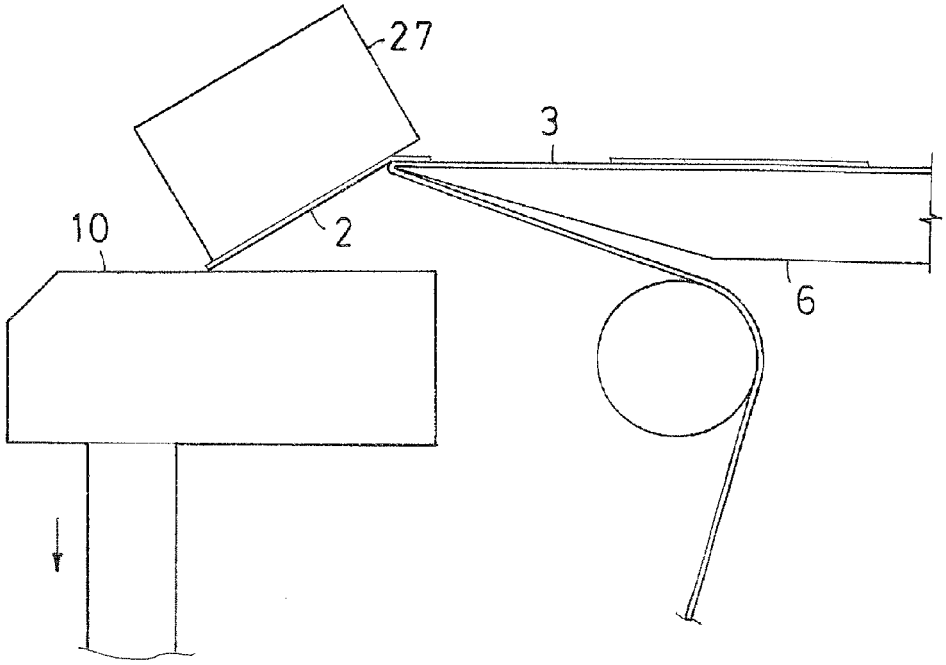
FIG. 5 is a side view of major portions showing a label joining process.

When label feeding is progressed and part of the rear end portion of the label 2 remains on the release paper 3 only by a predetermined amount, the suction head 27 is lowered to bring closer to the top surface (front surface) of the label 2 as shown in FIG. 5. In this case, the suction head 27 is brought closer to the label 2 in an inclined posture similar to the posture of the label 2 such that the suction surface on the bottom surface droops and is inclined, and then sucks the top surface of the label 2.

Figure 6:
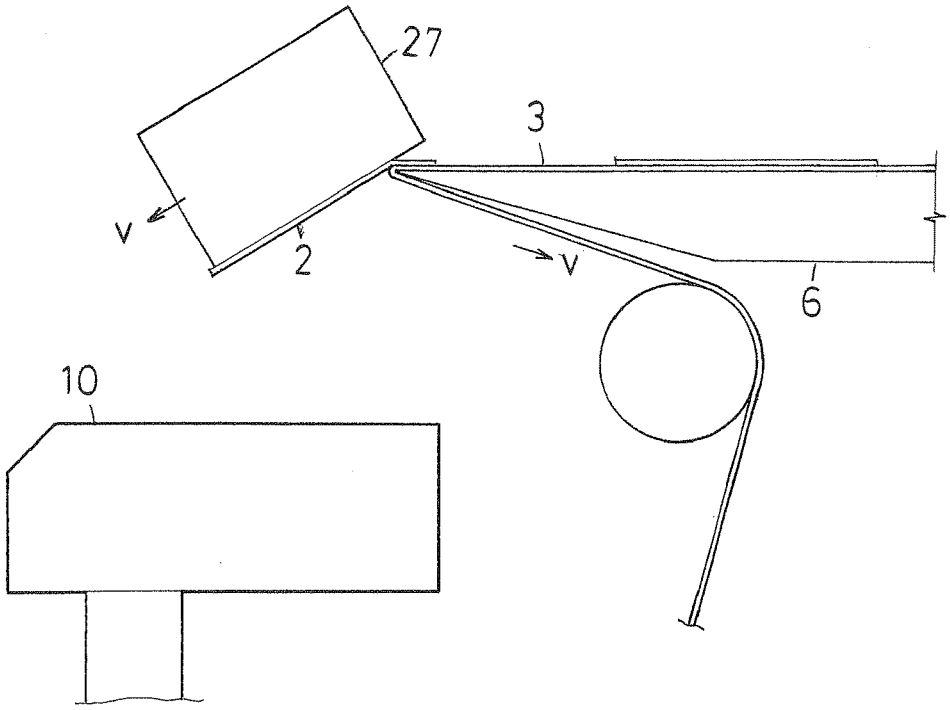
FIG. 6 is a side view of major portions showing a label joining process.

When the label 2 is sucked, the receiver base 10 is lowered and located far away from the suction head 27, and the operating arm 23 swings downward and forward due to contraction of the swing cylinder 24, as shown in FIG. 6. Accordingly, the suction head 27 moves substantially linearly (strictly speaking, showing a circular trajectory having a large curvature) along the suction surface at a feeding speed of the label 2, that is a speed v synchronous with the moving speed v of the release paper 3. Consequently, the rear end portion of the label separated and fed from the release paper 3 is sucked by the suction head 27.

Figure 7:
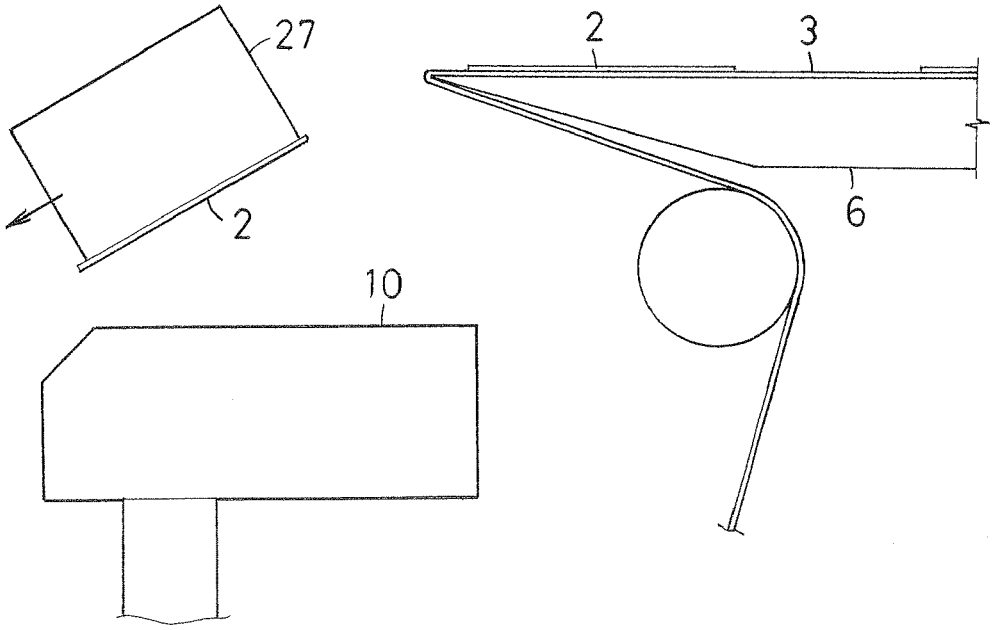
FIG. 7 is a side view of major portions showing a label joining process.

As shown in FIG. 7, the suction head 27 that suction-holds the label 2 is moved forward and downward. Along with such movement, while the operating arm 23 swings forward and downward, the lifting cylinder 26 is contracted, so that the suction head 27 suction-holding the label 2 is moved upward. When the lifting cylinder 26 is set in a perpendicular posture, swing of the operating arm 23 is stopped, and thereafter, the transfer mechanism 9 is driven to move forward. That is, the pickup mechanism 8 suction-holding one single label 2 is moved forward to the joining position b.

The label 2 transferred to the joining position b is lowered by expansion of the lifting cylinder 26, and is pressed and joined directly to a predetermined position of the mount frame MF that is held below by a holding table. A sequence of the label joining operations of the apparatus according to the present embodiment is completed, and the same operation is repeated thereafter.

As described above, the receiver base 10 is lowered synchronously with the feeding speed of the label 2 while the predetermined inclination angle θ of the label 2 is maintained, the label 2 and the suction surface of the suction head 27 are set in substantially same inclined postures with part of the rear end portion of the label 2 remaining on the release paper 3 only by a predetermined amount, and the label 2 is suction-held to the suction surface. This operation prevents a printed matter on the surface of the label from being rubbed when the label is sucked.

Further, the suction head 27 is swung with a curvature similar to a straight line at a speed synchronous with the feeding speed of the label 2. Accordingly, the printed surface of the label 2 is never rubbed with the suction surface of the suction head 27 until the label 2 is completely separated from the release paper 3.

The present invention is not limited to the above-described embodiment, but may be modified as described below.

Figure 8:
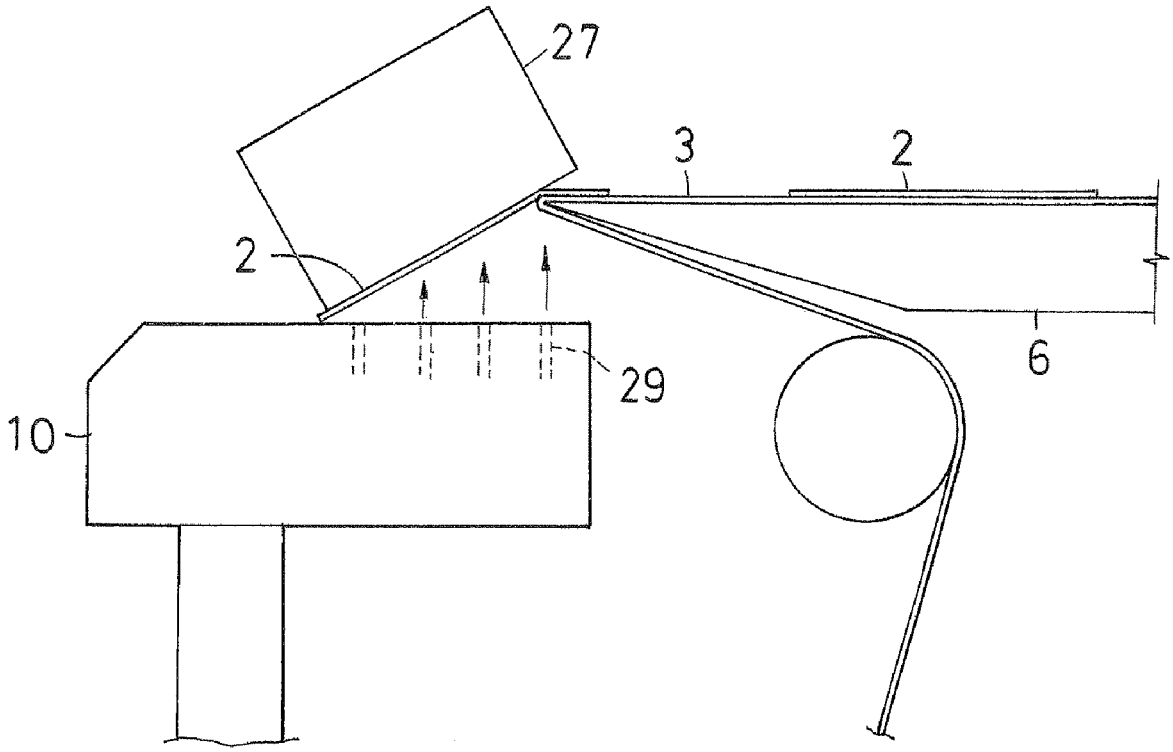
FIG. 8 is a side view of major portions showing a label joining process according to another embodiment.

(1) As shown in FIG. 8, a large number of air nozzles 29 may be formed on the top surface of the receiver base 10 so as to blow air against the rear face of the label 2. In this case, air is blown from the air nozzles 29 only in a process in which the suction head 27 is lowered to be brought closer to and sucks the label 2 fed from the front end portion of the edge member 6. The label 2 is pressed up by air blow pressure to be pressed onto the suction surface of the suction head 27. Consequently, suction of the label can be carried out further securely.

In the meantime, it is preferable to prepare in advance a plurality of types of the receiver bases 10 different in the number of the air nozzles, an arrangement pitch, and a diameter of the nozzles, so as to replace the receiver bases 10 in accordance with the size or thickness of the label 2 to be separated. Further, it is preferable to change a flow rate of air blow in accordance with the size or thickness of the label 2 so as to adjust the air blow pressure for pressing upward the label 2.

(2) Although in the above embodiment, the label 2 separated from the edge member 6 is sucked by the suction head 27, and after being transferred, the label 2 is joined directly to the mount frame MF, the label 2 may be transferred from the suction head 27 to another suction head.

(3) In the above embodiment, the operating arm 23 is swung forward and downward by contraction of the swing cylinder 24, and the suction head 27 is moved substantially linearly along the suction surface at the feeding speed of the label 2, that is the speed v synchronous with the moving speed v of the release paper 3. Alternatively, the suction head 27 may be controlled to move as follows. Specifically, it is possible to provide the movable base 21 with a drive mechanism, and move the movable base 21 substantially linearly in a direction for feeding the release paper 3 synchronously with the moving speed v of the release paper 3.

The present invention may be embodied in other specific forms without departing from the spirit or essential attributes thereof and, accordingly, reference should be made to the appended claims, rather than to the foregoing specification, as indicating the scope of the invention.

What is claimed is:

1. A label joining method for folding back and reversing an release paper that holds a label joined thereto while the release paper being fed forward, suction-holding from above by a suction head a printed surface of the label that is separated from the release paper by the folding-back and fed forward, and feeding and joining the label to a work piece, the method comprising the step of:

suction-holding the downward suction surface of the suction head onto the label by approaching the suction head in a forwardly inclined posture to a top of the label being separated so as to make the label and the suction surface parallel to each other under a state where a part of a rear end portion of the label is kept joining and holding onto the release paper while a front end portion of the label fed forward from a folded-back position of the release paper is received on a lifting receiver base to keep the label in a forwardly and downwardly inclined posture and by pressing the label to the work piece.

2. The label joining method according to claim 1, wherein, when the receiver base receives the front end of the label, the receiver base is simultaneously lowered in synchronization with a forward moving speed of the release paper.

3. The label joining method according to claim 1, wherein air is blown to the label from below when the label is sucked by the suction head.

4. The label joining method according to claim 1, wherein, after the label is sucked by the suction head in a process of separating the label from the release paper, the suction head is moved forward in a forwardly and downwardly inclined direction at a speed synchronous with the forward moving speed of the release paper.

* * * * *